US008774428B2

(12) United States Patent
Jaar et al.

(10) Patent No.: US 8,774,428 B2
(45) Date of Patent: Jul. 8, 2014

(54) VERY LOW POWER MEMS MICROPHONE

(75) Inventors: Karine Jaar, Cambridge, MA (US); Aleksey S. Khenkin, Nashua, NH (US)

(73) Assignee: Invensense, Inc., San Jose, CA (US)

( * ) Notice: Subject to any disclaimer, the term of this patent is extended or adjusted under 35 U.S.C. 154(b) by 258 days.

(21) Appl. No.: 13/162,903

(22) Filed: Jun. 17, 2011

(65) Prior Publication Data

US 2011/0311080 A1 Dec. 22, 2011

Related U.S. Application Data

(60) Provisional application No. 61/356,075, filed on Jun. 18, 2010.

(51) Int. Cl.
*H04R 3/00* (2006.01)
*H04R 19/00* (2006.01)
*H04R 19/04* (2006.01)

(52) U.S. Cl.
CPC ..... *H04R 3/00* (2013.01); *H04R 19/005* (2013.01); *H04R 19/04* (2013.01)
USPC ..... 381/111; 381/113; 381/174

(58) Field of Classification Search
USPC ..... 381/111, 113, 360, 174
See application file for complete search history.

(56) References Cited

U.S. PATENT DOCUMENTS 7,912,236 B2 * 3/2011 Dehe et al. ..... 381/175
7,929,716 B2 * 4/2011 Niwa et al. ..... 381/113
2008/0298621 A1 * 12/2008 Theuss et al. ..... 381/360
2009/0202089 A1 8/2009 Zhang et al. ..... 381/174
2011/0200212 A1 * 8/2011 Wismar ..... 381/174

OTHER PUBLICATIONS

Leung et al., "A Sub-1V 15-ppm/° C. CMOS Bandgap Voltage Reference Without Requiring Low Threshold Voltage Device", IEEE Journal of Solid-State Circuits, vol. 37, No. 4, pp. 526-530, Apr. 2002.
Sansen, Willy M.C., "Analog Design Essentials", Springer, 3 pages, 2006.
Sansen , Willy M.C., "Analog Design Essentials", Springer, p. 477, 2006.
Peng et al., "A Charge-Based Low-Power High-SNR Capacitive Sensing Interface Circuit", IEEE Trans Circuits Syst I Regul Pap. 2008, vol. 55, No. 7, 29 pages, Sep. 11, 2008.
Kiaei et al., Micro-Power Multi-Phase MEMS Hearing Aid, Global Institute of Sustainability, Arizona State University, http://sustainability.asu.edu/research/project.php?id=554,1 page, 2007-2011.

* cited by examiner

*Primary Examiner* — Davetta W Goins
*Assistant Examiner* — Amir Etesam
(74) *Attorney, Agent, or Firm* — Maryam Imam; IPxLAW Group LLP

(57) ABSTRACT

A MEMS microphone is capable of operating with less-than-one-volt bias voltage. An exemplary MEMS microphone can operate directly from a power rail (i.e., directly from VDD), i.e., without a DC-to-DC step-up voltage converter or other high bias voltage generator. The MEMS microphone has high mechanical and electrical sensitivity due, at least in part, to having high-compliance, i.e. low stiffness, springs and a relatively small gap between its diaphragm and its parallel conductive plate. In some embodiments, a diode-based voltage reference or a bandgap voltage reference supplies the bias voltage.

24 Claims, 11 Drawing Sheets

VERY LOW POWER MEMS MICROPHONE

CROSS REFERENCE TO RELATED APPLICATIONS

This application claims the benefit of U.S. Provisional Patent Application No. 61/356,075, filed Jun. 18, 2010, titled "Very Low Power MEMS Microphone," the entire contents of which are hereby incorporated by reference herein, for all purposes.

TECHNICAL FIELD

The present invention relates to microelectromechanical systems (MEMS) microphones and, more particularly, to MEMS microphones that operate on low bias voltages.

BACKGROUND ART

Microelectromechanical systems (MEMS) microphones are commonly used in mobile telephones and other consumer electronic devices, embedded systems and other devices. A MEMS microphone typically includes a conductive micromachined diaphragm that vibrates in response to an acoustic signal. The microphone also includes a conductive plate parallel to, and spaced apart from, the diaphragm. The diaphragm and the conductive plate collectively form a capacitor, and an electrical charge is placed on the capacitor, typically by an associated circuit referred to as a "bias circuit" or "bias generator." The capacitance of the capacitor varies rapidly as the distance between the diaphragm and the plate varies due to the vibration of the diaphragm caused by the acoustic signal. Typically, the charge on the capacitor remains essentially constant during these vibrations, so the voltage across the capacitor varies as the capacitance varies.

The varying voltage may be used to drive a circuit, such as an amplifier or an analog-to-digital converter, to which the MEMS microphone is connected. Such a circuit may be implemented as an application-specific integrated circuit (ASIC). A MEMS microphone connected to a circuit signal processing circuit is referred to herein as a "MEMS microphone system" or a "MEMS system." A MEMS microphone die and its corresponding ASIC are often housed in a common integrated circuit package to keep leads between the microphone and the ASIC as short as possible, such as to avoid parasitic capacitances caused by long leads.

The sensitivity of a MEMS microphone depends, at least in part, on the bias voltage applied across the diaphragm and the conductive plate, with a higher voltage yielding a higher sensitivity. However, supply voltages ("rail" voltages) within battery-powered electronic circuits, such as hearing aids, mobile telephones and Bluetooth headsets, are typically insufficient to directly bias MEMS microphones. Therefore, DC-to-DC step-up converters, such as charge pumps, are utilized to generate the required bias voltages. However, DC-to-DC step up converters may be temperature sensitive, which causes the sensitivity of conventional MEMS microphones to depend on temperature.

Furthermore, charge pumps are inefficient, and in general, DC-to-DC step-up converters are significant sources of power drain in these circuits. Their use, therefore, negatively influences battery life. As a point of comparison, a typical hearing aid electret condenser microphone (ECM) draws approximately 50 microamps (μA) and does not require a bias voltage. In contrast, a typical MEMS microphone requires more than 100 μA to power its bias generator. Reducing the amount of power required by a MEMS microphone would, therefore, provide a significant advantage.

SUMMARY OF EMBODIMENTS

Embodiments of the present invention provide MEMS microphones capable of operating on low bias voltages, such as less-than-one-volt bias voltages. Such MEMS microphones can be used in circuits that operate on low voltage power supplies, such as less-than-one-volt power supplies, without DC-to-DC step-up voltage converters. These MEMS microphones find applicability in low power drain circuits or systems with low rail voltages, such as battery-powered electronic devices.

An embodiment of the present invention provides a MEMS microphone system that includes a MEMS microphone die that includes a micromachined electrode and another micromachined structure. The other micromachined structure is moveable, with respect to the electrode. The movable structure and the electrode are configured to establish a capacitance therebetween that varies in response to an acoustic signal. A bias circuit is coupled to the electrode and/or to the movable structure and configured to apply a bias voltage less than about 3 volts.

The bias circuit may be configured to apply the bias voltage without a charge pump. The bias circuit may be configured to be coupled to a power supply voltage and to apply the bias voltage at less than, or equal to, the power supply voltage. The bias circuit may be included on the MEMS microphone die. The bias circuit may include a voltage reference circuit. The voltage reference circuit may include a diode-based voltage reference circuit or a bandgap-based reference circuit. The voltage reference circuit may be configured to produce a reference voltage greater than a bandgap voltage or a reference voltage between a bandgap voltage and about 1 volt. The bias circuit may include an amplifier coupled between the voltage reference circuit and the electrode and/or the movable structure. The bias circuit may include a filter. The filter may be coupled between the voltage reference circuit and the electrode and/or the movable structure.

The MEMS microphone system may include a signal processing circuit coupled to the electrode and/or the movable structure. The signal processing circuit may be configured to process an electrical signal from the electrode and/or the movable structure. A voltage regulator may be coupled to the signal processing circuit. The voltage regulator may be configured to provide power to the signal processing circuit. An output signal from the from the voltage reference circuit or from the amplifier may be coupled to the voltage regulator so as to control the voltage regulator. The voltage reference circuit may include a bandgap-based voltage reference circuit configured to produce a reference voltage between a bandgap voltage and about 1 volt. The MEMS microphone die may include the bias circuit.

The bias circuit may be configured to apply the bias voltage at less than about 2.5 volts, less than about 2.4 volts, less than about 1.8 volts, less than about 1.5 volts, less than about 1.0 volts or less than about 0.9 volts.

A lid may be attached to a substrate to define a chamber, and the MEMS microphone die and the bias circuit may be disposed within the chamber.

Another embodiment of the present invention provides a method for biasing a MEMS microphone. The method includes generating a bias voltage that is less than the voltage of a power supply to which the MEMS microphone is coupled and applying the generated bias voltage to the MEMS microphone.

Generating the bias voltage may include generating a bandgap-based reference voltage. The bandgap-based reference voltage may be between a bandgap voltage and about 1 volt.

BRIEF DESCRIPTION OF THE DRAWINGS

The invention will be more fully understood by referring to the following Detailed Description of Specific Embodiments in conjunction with the Drawings, of which.

DETAILED DESCRIPTION OF SPECIFIC EMBODIMENTS

Disclosed embodiments of MEMS microphones are capable of operating with less-than-one-volt bias voltages. These embodiments can be used in circuits that operate with less-than-one-volt power supplies. Such MEMS microphones find applicability in low power drain circuits or systems with low rail voltages, such as battery-powered electronic devices, such as hearing aids and mobile telephones. Exemplary MEMS microphones can operate directly from power rails (i.e., directly from $V_{DD}$), i.e., without DC-to-DC step-up voltage converters. (As used herein, "directly from a power rail" or "directly from $V_{DD}$" means without a step-up voltage converter that generates a voltage greater than the power rail voltage or greater than $V_{DD}$.)

Figure 1:
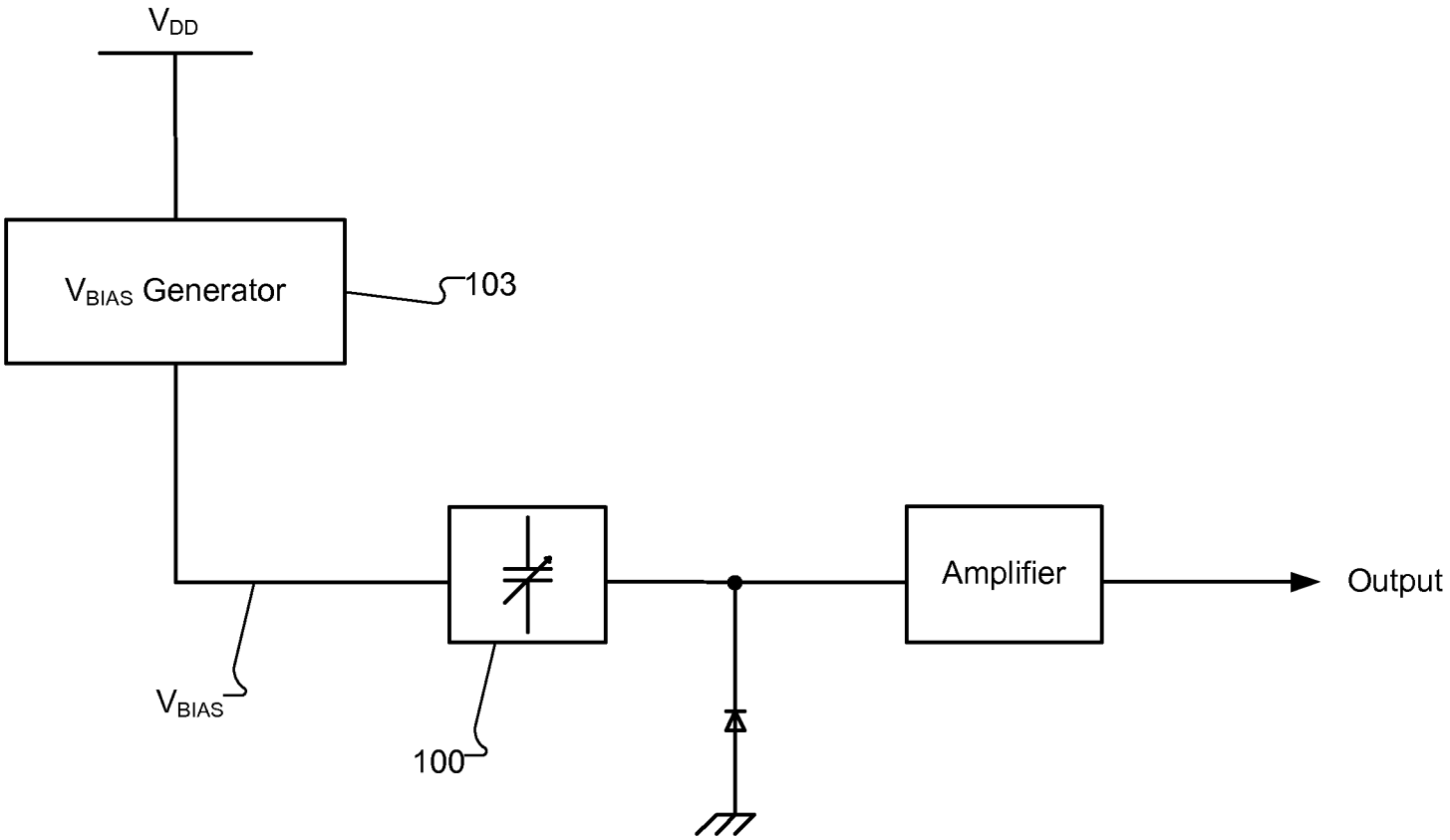
FIG. 1 is a schematic block diagram of a prior art MEMS microphone system.

FIG. 1 is a schematic block diagram of a prior art MEMS microphone system, in which a MEMS microphone 100 is biased by a $V_{BIAS}$ generator 103 which, in turn, is powered from a $V_{DD}$ rail. Bias voltages ($V_{BIAS}$) as low as about 4 volts (V) and as high as about 12 V are typically required for prior art MEMS microphones. These bias voltages are typically higher than rail voltages ($V_{DD}$, also referred to herein as "power supply voltage"), thereby requiring charge pumps or other DC-to-DC step-up voltage converters. As noted, step-up voltage converters disadvantageously reduce battery life and introduce temperature sensitivities. In some exemplary MEMS microphone systems, the stepped-up voltage converter is implemented as an ASIC, and it may be included in the same semiconductor package as the MEMS microphone die. As used herein, "power supply voltage" does not include output from a charge pump or other DC-to-DC step-up voltage converter. Instead, power supply voltage refers to generally available power within a circuit or system, such as a rail voltage, a voltage from a general power supply or a battery.

Embodiments of the present invention avoid these problems by eliminating the need for a DC-to-DC step-up voltage converter. A MEMS microphone's sensitivity depends on several factors, including its mechanical sensitivity and its electrical sensitivity. Mechanical sensitivity, i.e., how far the MEMS microphone's diaphragm moves for a given sound pressure level (SPL), depends on several factors, including size (area) of the diaphragm and stiffness of springs that support the diaphragm. Electrical sensitivity, i.e., how much the MEMS microphone's capacitance varies in response to a given SPL, depends on several factors, including the separation distance ("gap") between the diaphragm and the parallel conductive plate (the sensitivity is inversely proportional to gap size) and the bias voltage (the sensitivity is proportional to bias voltage).

Embodiments of the present invention employee high-compliance, i.e. low stiffness, springs, which enable the diaphragm to move relatively large distances in response to comparatively small forces exerted by impinging acoustic signals. In addition, embodiments of the present invention have relatively small gaps. Consequently, these embodiments provide adequate sensitivity, even with relatively low bias voltages. Construction of a MEMS microphone having high-compliant springs and a small gap is described in U.S. patent application Ser. No. 12/411,768, titled "Microphone with Reduced Parasitic Capacitance," by Zhang, et al., filed Mar. 26, 2009, published Aug. 13, 2009 as US Pat. Publ. No. 2009/0202089 and assigned to the assignee of the present application, the entire contents of which are hereby incorporated by reference herein for all purposes.

Several exemplary embodiments will now be described with reference to corresponding schematic block circuit diagrams. Each of these embodiments exemplifies one or more specific features; however, other embodiments (including embodiments not shown) may include one or more of these features in combination or in combinations not shown here. The disclosed embodiments are presented in order according to their approximate complexity.

Figure 2:
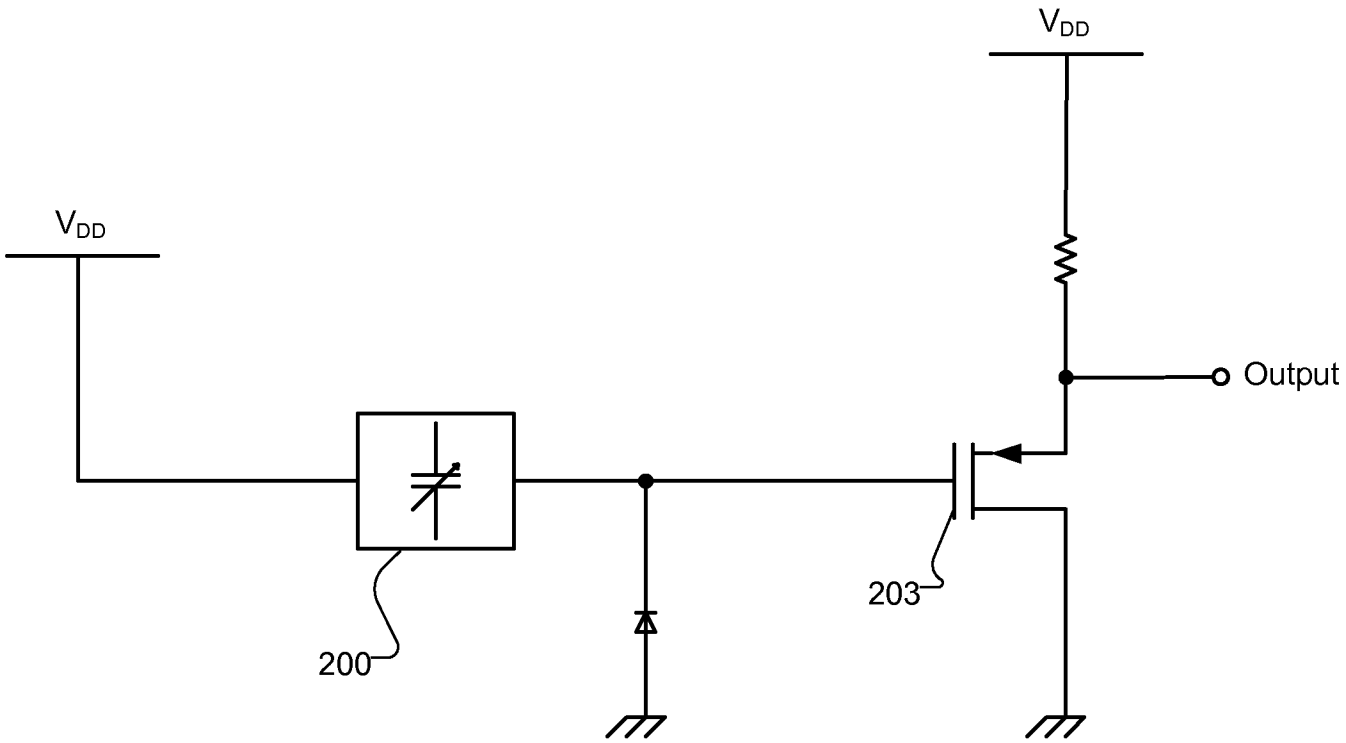
FIG. 2 is a schematic block diagram of a low bias voltage MEMS microphone circuit, according to an embodiment of the present invention.

FIG. 2 is a schematic block diagram of a low bias voltage MEMS microphone circuit, according to an embodiment of the present invention. A MEMS microphone 200 is biased directly from a rail ($V_{DD}$), where $V_{DD}$ is as low as approximately 1 V or, in some embodiments, less than 1 V. A field effect transistor (FET) 203 and a resistor 206 form an impedance converter buffer stage between the MEMS microphone 200 and subsequent circuitry (not shown). The simplicity of the buffer allows integration of the buffer 203/206 and the MEMS microphone 200 on a single semiconductor die or within a single semiconductor package, thereby reducing parasitic capacitances and minimizing physical dimensions. The resulting MEMS microphone circuit draws as little as about 10-20 μA.

Figure 3:
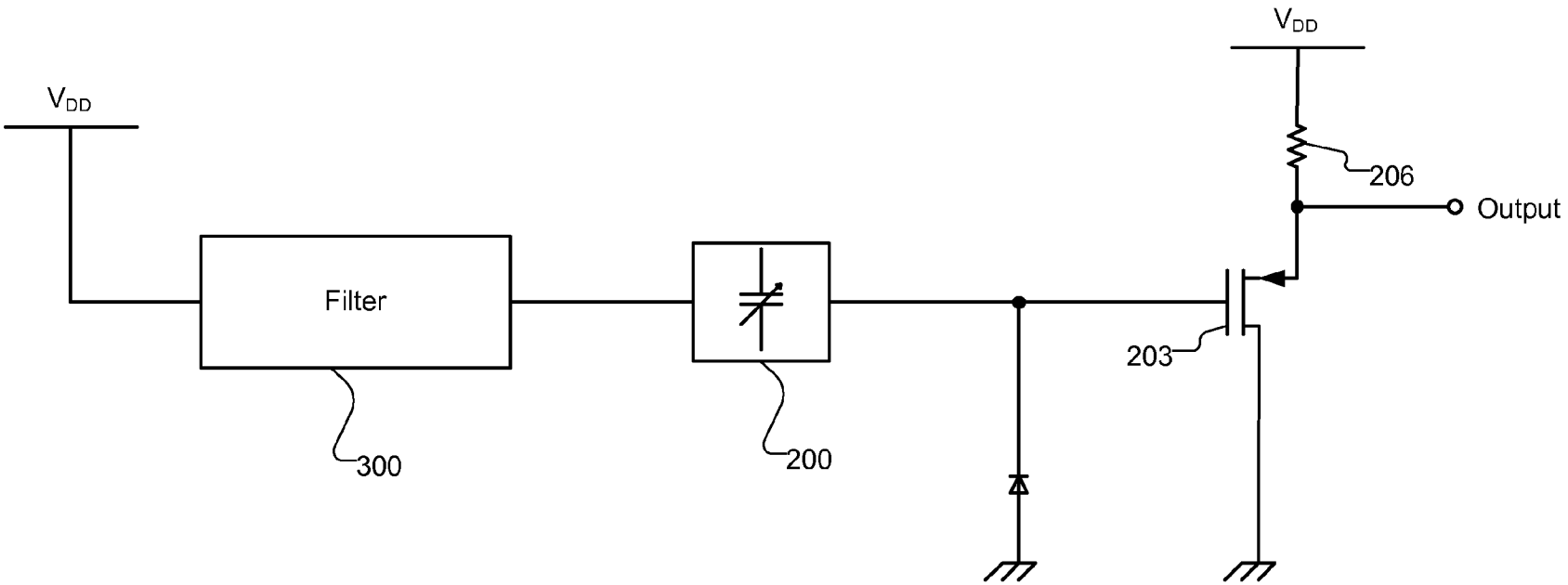
FIG. 3 is a schematic block diagram of a low bias voltage MEMS microphone circuit that includes a filter, according to another embodiment of the present invention.

FIG. 3 is a schematic block diagram of another low bias voltage MEMS microphone circuit, similar to the circuit shown in FIG. 2, except with the inclusion of a low-pass filter 300 to provide better power supply rejection (PSR) than the circuit of FIG. 2. The filter 300 may be implemented with a PMOS transistor or any other appropriate filter circuit. With the circuit of FIG. 2, i.e., without a filter, it is possible to introduce some high-frequency noise into the output signal. However, the filter 300 shown in FIG. 3 can provide about −15 to about −20 dB of noise rejection.

The MEMS microphone circuits of FIGS. 2 and 3 provide bias voltages directly from the rail. If the rail's voltage is adequately regulated, no additional regulation may be necessary for the bias voltage. For example, a regulated $V_{DD}$ in the range of about 0.9 V to about 1.4 V may be used to directly bias the MEMS microphone 200. Even if the rail's voltage is not regulated, in some contexts, the bias voltage need not be separately regulated. For example, a power supply (not shown), such as a battery, that powers the rail may be temperature sensitive. However, in a device such as a hearing aid, the temperature of the device is kept relatively constant, due to its contact with a human body. Thus, the power supply is maintained at a relatively constant temperature and consequently produces a relatively constant rail voltage.

Figure 4:
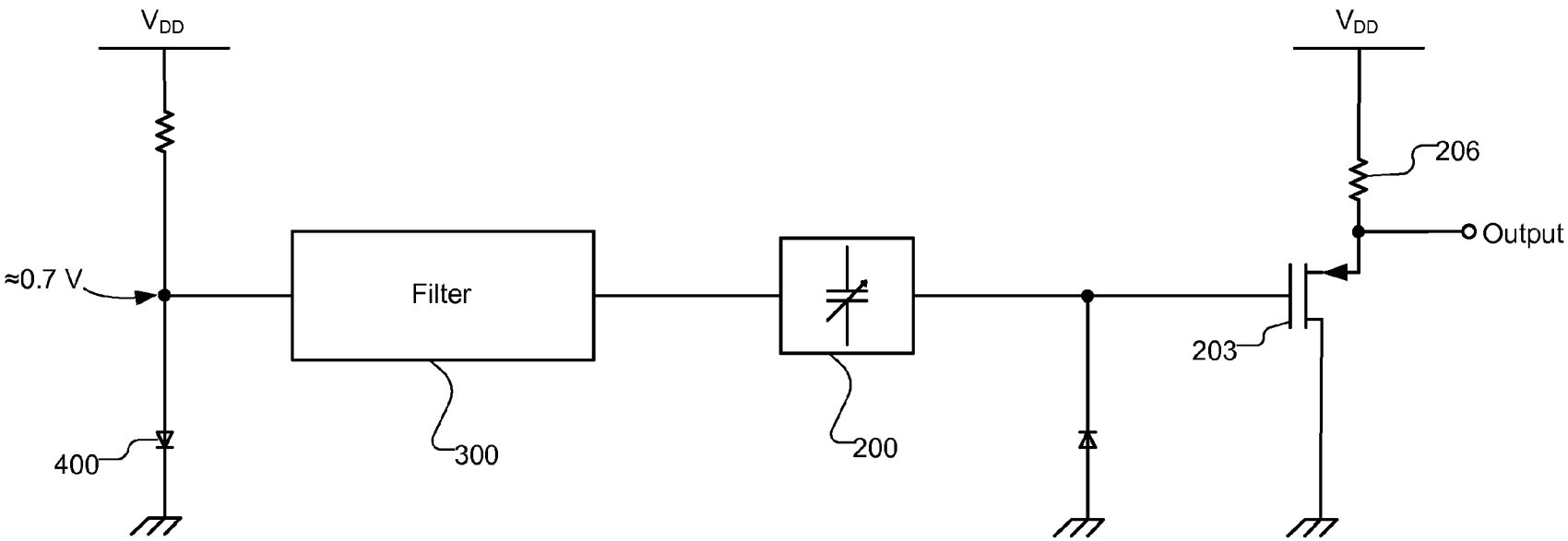
FIG. 4 is a schematic block diagram of a low bias voltage MEMS microphone circuit that includes a diode voltage regulator, according to yet another embodiment of the present invention.

If regulation of the bias voltage is important, such as because the rail voltage is not regulated or the rail voltage is not adequately regulated, a MEMS microphone circuit with a voltage regulator, such as the one shown schematically in FIG. 4, may be used. In the circuit shown in FIG. 4, a silicon diode 400 is used to produce a regulated approximately 0.7 V bias voltage. The voltage regulation provided by the diode 400 is quite temperature stable and does not vary with fluctuations in supply of ($V_{DD}$) voltage, because the regulation is based on the forward voltage drop inherent in the diode. Similarly, if a MEMS microphone circuit is required to maintain a relatively constant sensitivity over a wide temperature range, such as between about −40° F. and about +75° F., a regulator for the bias voltage supply may be necessary or desirable.

Regardless of whether a bias voltage regulator is used or not, in most battery-powered circuits, the bias voltage requirement of a MEMS microphone according to the present disclosure is likely to be less than the voltage requirement of any other portion of the circuit. Consequently, as the battery discharges and the voltage supplied by the battery decreases over time, the MEMS microphone is likely to be the last component of the circuit to receive adequate voltage. In other words, the sensitivity of the MEMS microphone will remain adequate at least until the battery voltage is too low to operate the remainder of the circuit or other portions of the circuit.

In many applications, no regulation is required for the bias voltage. Consequently, if no other portion of a circuit requires regulated rail voltage, the rail voltage need not be regulated for the benefit of the MEMS microphone, thereby reducing power supply complexity and cost.

In circuits such as the one shown in FIG. 4, using a silicon diode regulator causes an approximately 0.7 V drop across the diode 400. If a bias voltage greater than 0.7 V is desired, such as to provide increased MEMS microphone sensitivity, regulated output from a diode regulator may be amplified to provide a higher bias voltage, as exemplified by the MEMS microphone schematic block diagram of FIG. 5. An amplifier 500 provides a higher bias voltage, to the extent made possible by the rail voltage. For example, if the rail voltage drops to 0.9 V, and the amplifier 500 provides a gain of 1.2, the amplifier 500 provides a bias voltage of 0.84 V. Of course, the amplifier 500 can not provide a bias voltage greater than the rail voltage, because an amplifier can not provide an output voltage greater than its supply voltage. An amplifier is not, therefore, considered to be a step-up voltage converter. However, using such an amplifier, the MEMS microphone 200 can be biased at a voltage greater than the diode drop voltage (0.7 V). The amplifier 500 can be a low bandwidth amplifier, thereby requiring little current. The amplifier 500 is expected to draw approximately 3 μA.

Figure 5:
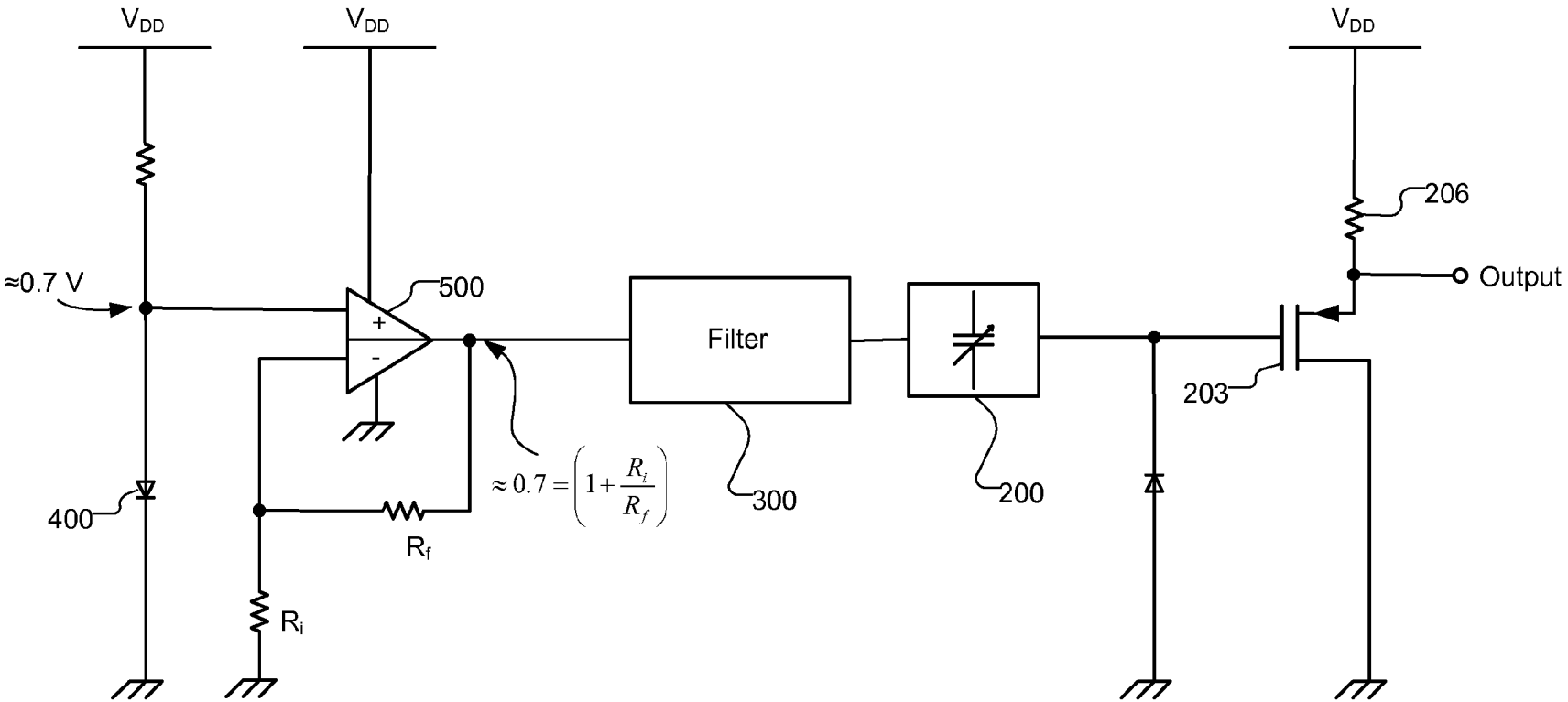
FIG. 5 is a schematic block diagram of a low bias voltage MEMS microphone circuit that includes a diode voltage regulator followed by an amplifier to provide gain, according to another embodiment of the present invention.
Figure 6:
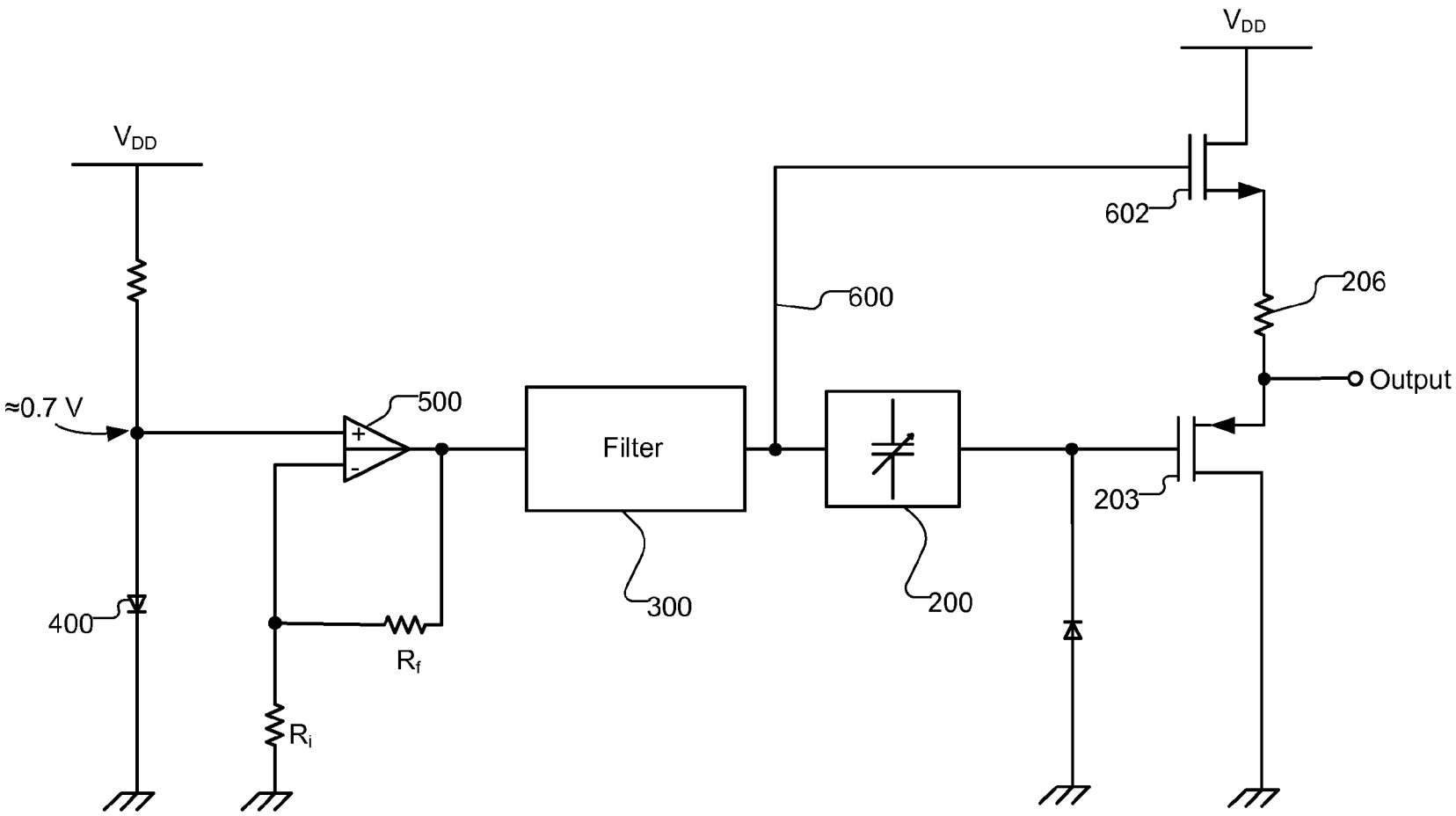
FIG. 6 is a schematic block diagram of a low bias voltage MEMS microphone circuit that includes a second voltage regulator, according to yet another embodiment of the present invention.

FIG. 6 is a schematic block diagram of a MEMS microphone circuit that provides the increased sensitivity and improved power supply rejection ratio (PSRR) of the circuit shown in FIG. 5, as well as a reduced bias current variation with changes in the supply voltage. In this circuit, the regulated bias voltage 600 is also used to drive a second voltage regulator 602 implemented as a native NMOS FET, which has a small voltage drop. Using a single amplifier 500 to both generate the bias voltage 600 and to drive the second voltage regulator 602 provides a particularly energy-efficient circuit. In the circuit of FIG. 6, the second voltage regulator 602 provides electrical power to the buffer 203/206. However, in other embodiments, the second voltage regulator 602 may power another signal processing circuit, such as an analog-to-digital (A/D) converter (not shown).

Figure 7:
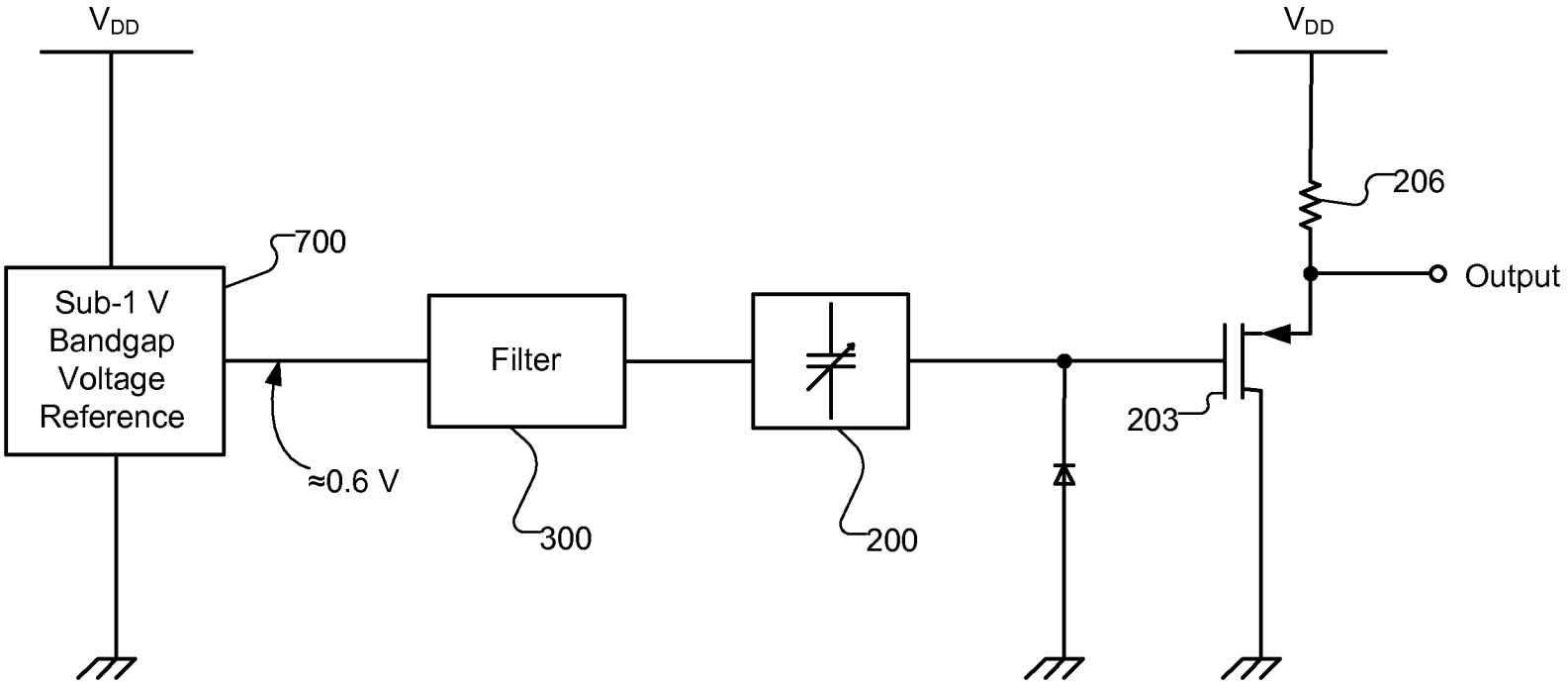
FIG. 7 is a schematic block diagram of a low bias voltage MEMS microphone circuit that includes a bandgap voltage reference, according to an embodiment of the present invention.

FIG. 7 is a schematic block diagram of a MEMS microphone circuit that provides improved temperature stability and power supply rejection. A sub-1-V bandgap voltage reference 700 provides a constant approximately 0.6 V bias voltage. Sub-1-V bandgaps voltage references are well known in the art. See, for example, Ka Nang Leung, et al., A Sub-1-V 15-ppm/° C. CMOS Bandgap Voltage Reference Without Requiring Low Threshold Voltage Device, IEEE Journal of Solid-State Circuits, Vol. 37, No. 4, April, 2002, the entire contents of which are hereby incorporated by reference herein. Advantageously, a bandgap regulator generates a voltage that is constant over process, temperature and input voltage variations, and it rejects power supply noise and ripple. A typical bandgap reference provides regulation of better than about ±1%, whereas a typical regulated power supply provides regulation of only about ±5%. In addition, part-to-part variation is very small width bandgap regulators.

Figure 8:
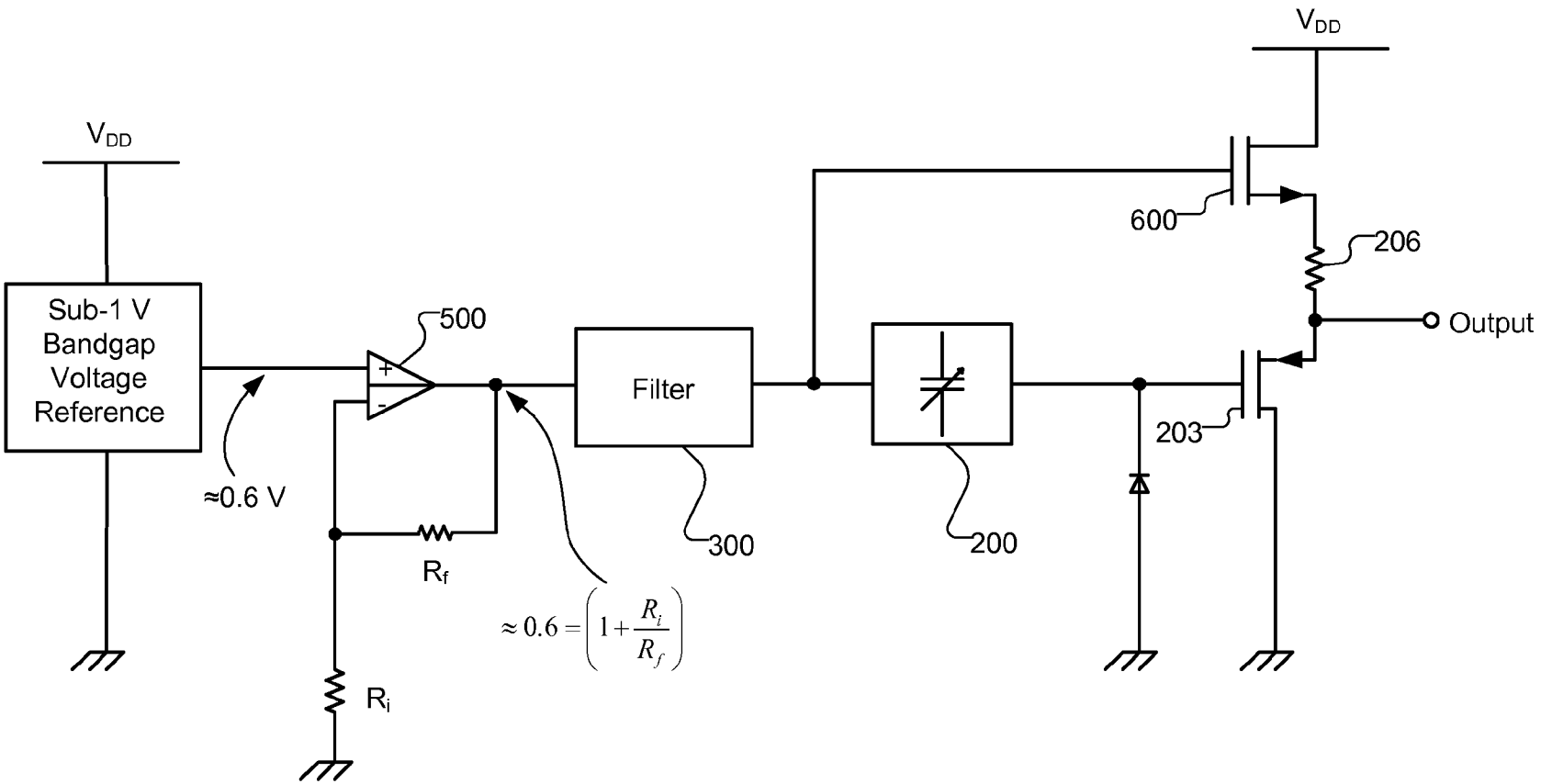
FIG. 8 is a schematic block diagram of a low bias voltage MEMS microphone circuit that includes a bandgap voltage reference and an amplifier, according to another embodiment of the present invention.

FIG. 8 is a schematic block diagram of a MEMS microphone circuit the combines the sub-1-V bandgap voltage reference 700 described above with reference to FIG. 7 and the amplifier 500 described above with reference to FIG. 5 and the second voltage regulator 600 described above with reference to FIG. 6. This circuit provides the improved characteristics described above with the above referenced figures.

Figure 9:
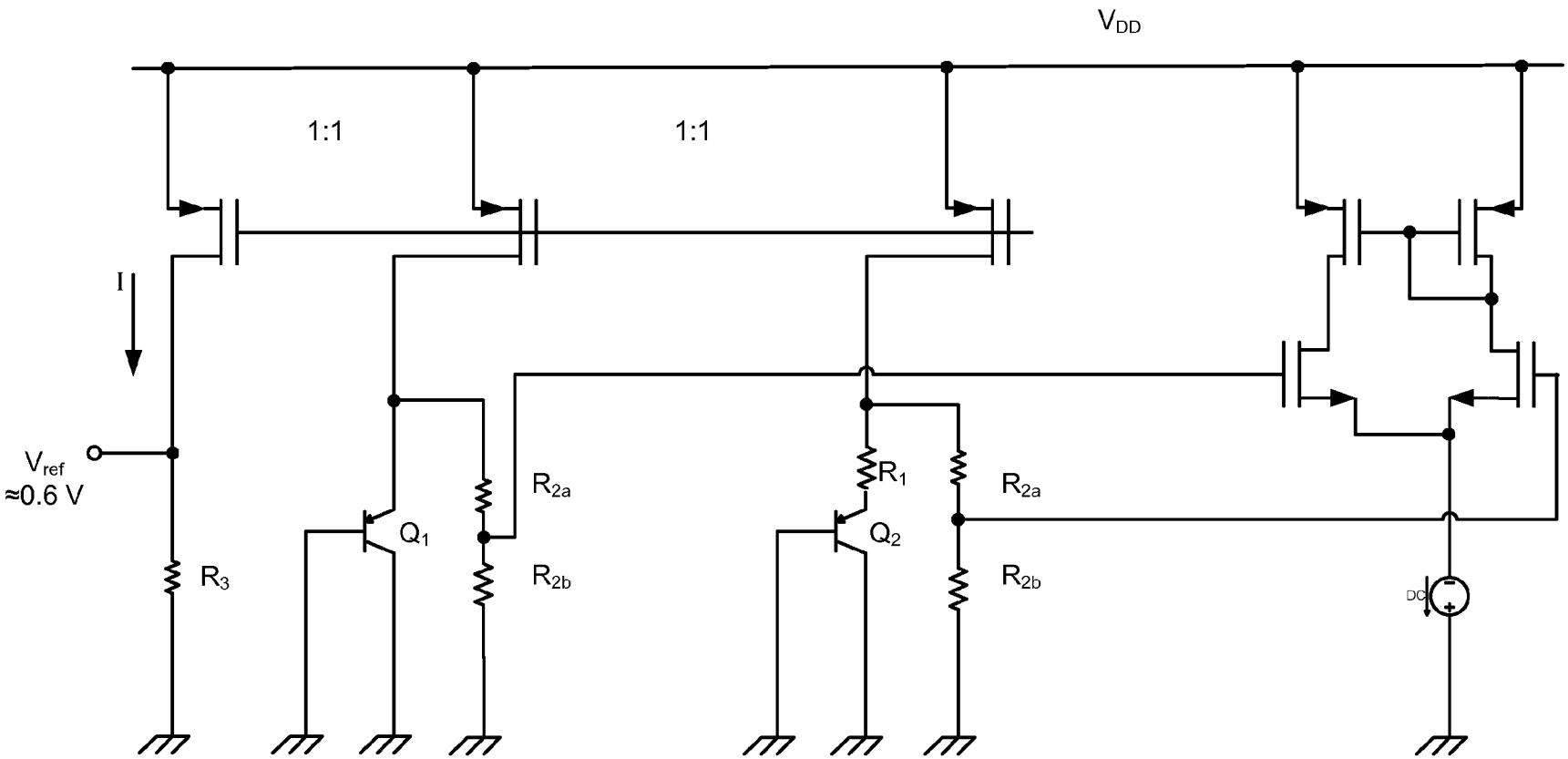
(Prior Art) Fig. 9
FIG. 9 is a schematic block diagram of a prior art bandgap voltage reference circuit.

FIG. 9 is a schematic block diagram of a prior art bandgap voltage reference that produces approximately 0.6 V. For more information about the circuit of FIG. 9 see, for example, the above referenced article by Leung.

Figure 10:
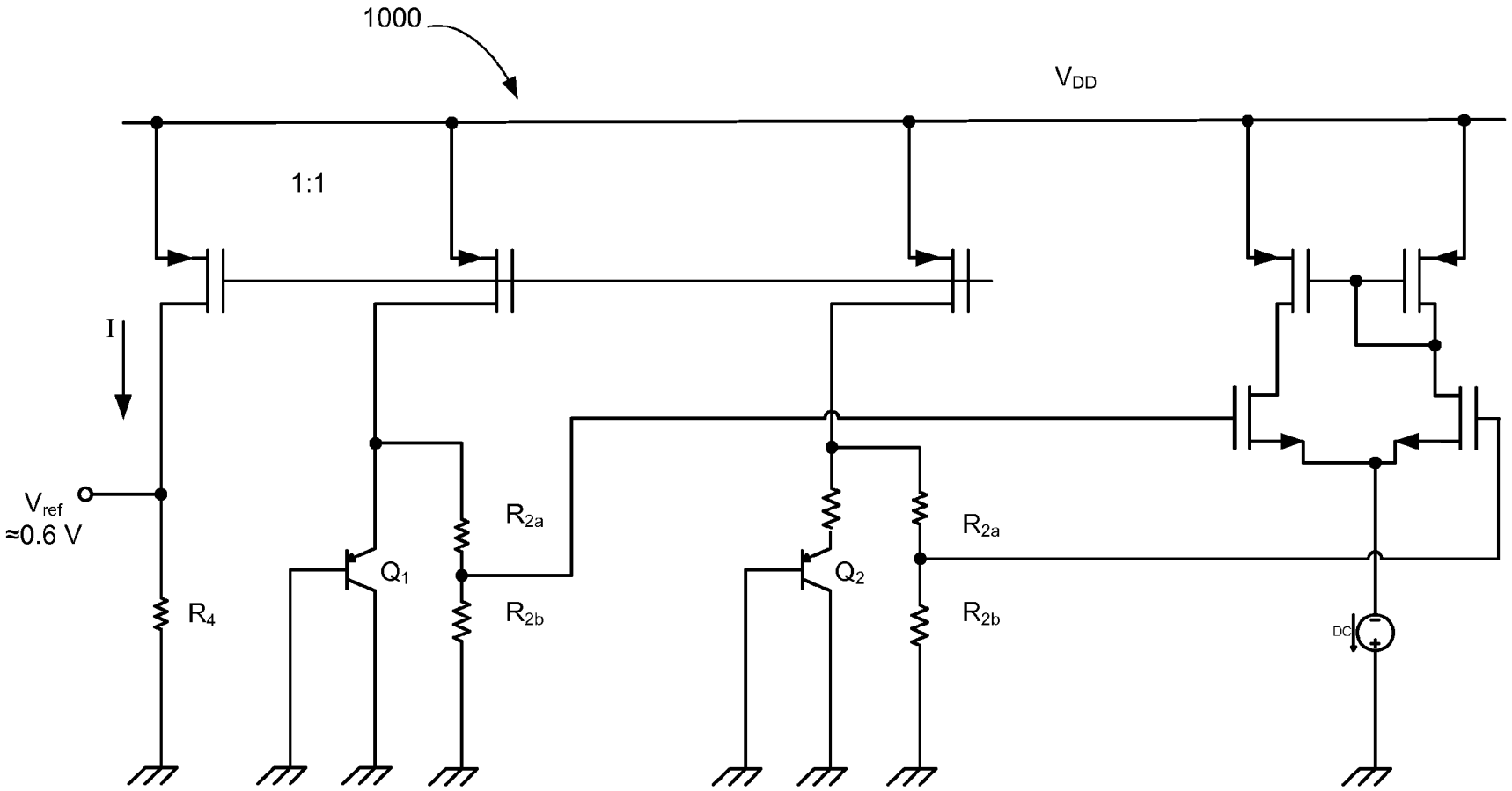
FIG. 10 is a schematic block diagram of a bandgap voltage reference circuit, according to an embodiment of the present invention.

FIG. 10 is a schematic block diagram of a voltage reference that produces a $V_{ref}$ greater than the $V_{ref}$ produced by the circuit of FIG. 9. The circuit of FIG. 10 is similar to the circuit of FIG. 9, except R4>R3. Because the current (I) that flows through R3 (FIG. 9) is the same as the current (I) that flows through R4 (FIG. 10), the $V_{ref}$ provided by the circuit of FIG. 10 is greater than the $V_{ref}$ in FIG. 9. For example, if R4=1.5*R3, the $V_{ref}$ produced by the circuit of FIG. 10 is approximately 0.9 V.

The $V_{ref}$ output of the circuit of FIG. 10 is not a bandgap voltage. Consequently, there may be some fluctuations in this output. However, where temperature sensitivity or process variations are not of most importance, this fluctuation may be acceptable in order to achieve a higher than bandgap reference voltage and to avoid the power consumption of the amplifier 500 (FIG. 5) that would otherwise be necessary to generate a similar bias voltage.

Figure 11:
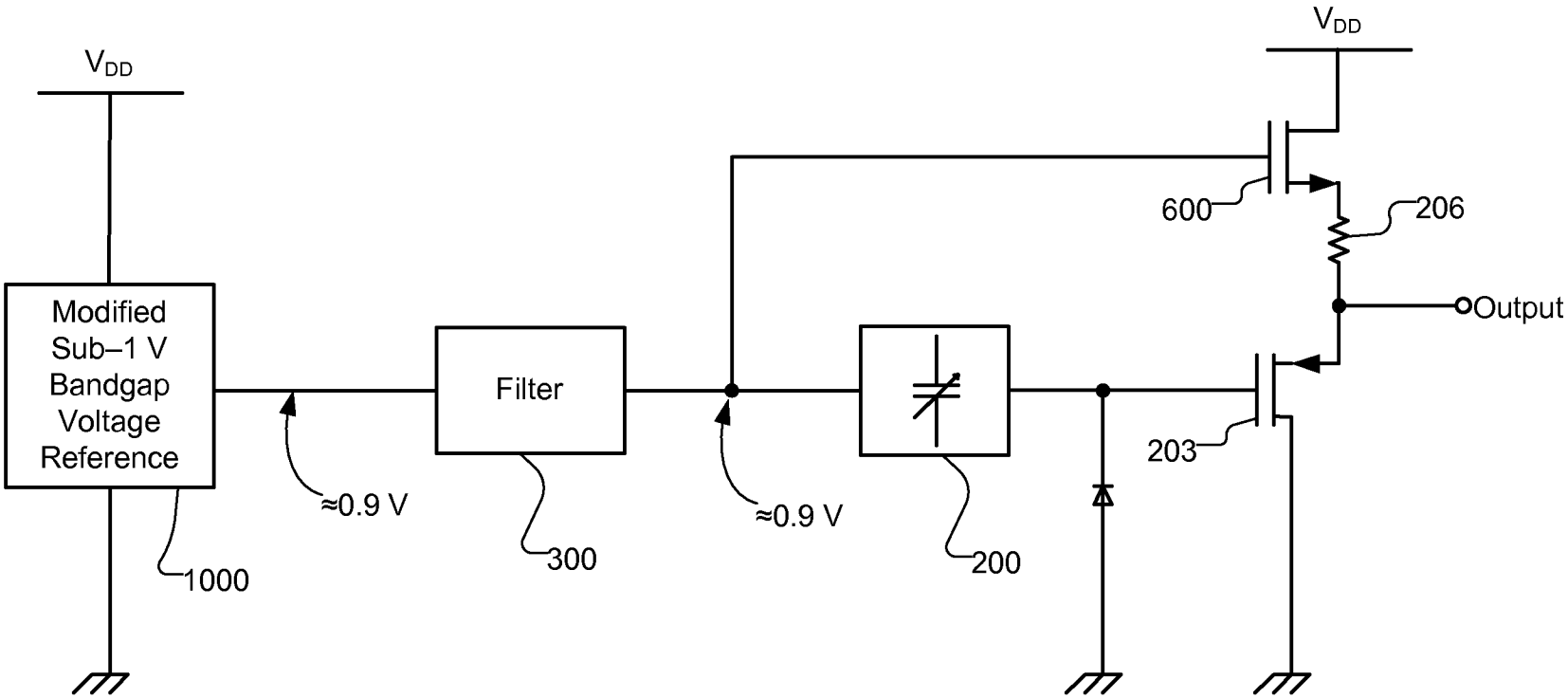
FIG. 11 is a schematic block diagram of a low bias voltage MEMS microphone circuit that includes a bandgap voltage reference circuit, according to yet another embodiment of the present invention.

FIG. 11 is a schematic block diagram of a MEMS microphone circuit that includes the modified sub-1-V bandgap voltage reference 1000 of FIG. 10 with the second voltage regulator 600 described above with reference to FIG. 6. The modified sub-1-V bandgap voltage reference 1000 may be implemented on the same die as the MEMS microphone 200. The circuit is currently believed to provide the best overall performance, i.e. a good trade-off providing low power consumption, a MEMS microphone sensitivity that varies little with power supply or temperature fluctuations and improved PSRR.

Of course, all the features of the circuit in FIG. 11 need not be employed in a given embodiment, depending on functional requirements of the MEMS microphone circuit.

A MEMS microphone, as taught herein, may provide adequate sensitivity with a relatively low bias voltage. Exemplary bias voltages include rail or $V_{DD}$ (where $V_{DD}$<3 V), 3.0 V, 2.5 V, 2.4 V, 1.8 V, 1.5 V, 1.0 V or 0.9 V. It should be noted that 0.9 V is the voltage provided by a spent alkaline battery. Therefore, an embodiment of a MEMS microphone as taught herein may be used in a circuit powered by an alkaline battery and provide adequate sensitivity, even when the battery is discharged to the point where the battery cannot power the remainder of the circuit, all without a step-up voltage converter.

A MEMS microphone, as disclosed herein, that provides adequate sensitivity with a low bias voltage obviates the need for a step-up converter, thereby eliminating the need for an ASIC or other circuit that provides high bias voltage. Consequently, embodiments of the present invention may be used to advantage in low power drain circuits or circuits with low rail voltages, such as battery-powered hearing aids and mobile telephones. The advantages include increased battery life and reduced cost, complexity and size made possible by the elimination of the need for step-up voltage converters.

While the invention is described through the above-described exemplary embodiments, it will be understood by those of ordinary skill in the art that modifications to, and variations of, the illustrated embodiments may be made without departing from the inventive concepts disclosed herein. Furthermore, disclosed aspects, or portions of these aspects, may be combined in ways not listed above. Accordingly, the invention should not be viewed as being limited to the disclosed embodiments.

What is claimed is:

1. A MEMS microphone system comprising:

a MEMS microphone die including a micromachined electrode and a micromachined structure, moveable with respect to the electrode and configured to establish a capacitance, with respect to the electrode that varies in response to an acoustic signal;

a bias circuit configured to be coupled to a power supply voltage, the bias circuit being coupled to at least one of the electrode and the movable structure and configured to apply a bias voltage, no greater than the power supply voltage and less than about 3 volts, thereto, wherein the bias circuit comprises:

a voltage reference circuit; and an amplifier coupled between the voltage reference circuit and the at least one of the electrode and the movable structure;

a signal processing circuit coupled to at least one of the electrode and the movable structure and configured to process an electrical signal therefrom; and a voltage regulator coupled to the signal processing circuit and configured to provide power thereto, wherein an output signal from the amplifier is coupled to the voltage regulator so as to control the voltage regulator.

2. A MEMS microphone system according to claim 1, wherein the bias circuit is configured to apply the bias voltage without a charge pump.

3. A MEMS microphone system according to claim 1, wherein the bias circuit is configured to apply the bias voltage at less than the power supply voltage.

4. A MEMS microphone system according to claim 1, wherein the bias circuit is configured to apply the bias voltage equal to the power supply voltage.

5. A MEMS microphone system according to claim 1, wherein the MEMS microphone die includes the bias circuit.

6. A MEMS microphone system according to claim 1, wherein the voltage reference circuit comprises a diode-based voltage reference circuit.

7. A MEMS microphone system according to claim 1, wherein the voltage reference circuit comprises a bandgap-based voltage reference circuit.

8. A MEMS microphone system according to claim 1, wherein the voltage reference circuit is configured to produce a reference voltage greater than a bandgap voltage.

9. A MEMS microphone system according to claim 1, wherein the voltage reference circuit is configured to produce a reference voltage between a bandgap voltage and about 1 volt.

10. A MEMS microphone system according to claim 1, wherein the bias circuit comprises a filter coupled between the voltage reference circuit and the at least one of the electrode and the movable structure.

11. A MEMS microphone system according to claim 1 further comprising:

a signal processing circuit coupled to at least one of the electrode and the movable structure and configured to process an electrical signal therefrom; and a voltage regulator coupled to the signal processing circuit and configured to provide power thereto;

wherein an output signal from the voltage reference circuit is coupled to the voltage regulator so as to control the voltage regulator.

12. A MEMS microphone system according to claim 11, wherein the voltage reference circuit comprises a bandgap-based voltage reference circuit configured to produce a reference voltage between a bandgap voltage and about 1 volt.

13. A MEMS microphone system according to claim 12, wherein the MEMS microphone die includes the bias circuit.

14. A MEMS microphone system according to claim 1, wherein the bias circuit comprises a filter.

15. A MEMS microphone system according to claim 1, further comprising a substrate and a lid attached to the substrate, thereby defining a chamber, wherein the MEMS microphone die and the bias circuit are disposed within the chamber.

16. A MEMS microphone system according to claim 1, wherein the bias circuit is configured to apply the bias voltage at less than about 2.5 volts.

17. A MEMS microphone system according to claim 1, wherein the bias circuit is configured to apply the bias voltage at less than about 2.4 volts.

18. A MEMS microphone system according to claim 1, wherein the bias circuit is configured to apply the bias voltage at less than about 1.8 volts.

19. A MEMS microphone system according to claim 1, wherein the bias circuit is configured to apply the bias voltage at less than about 1.5 volts.

20. A MEMS microphone system according to claim 1, wherein the bias circuit is configured to apply the bias voltage at less than about 1.0 volts.

21. A MEMS microphone system according to claim 1, wherein the bias circuit is configured to apply the bias voltage at less than about 0.9 volts.

22. A method for biasing a MEMS microphone, the MEMS microphone including a micromachined electrode and a micromachined structure, moveable with respect to the electrode and configured to establish a capacitance, with respect to the electrode, that varies in response to an acoustic signal, the method comprising:

generating a bias voltage less than voltage of a power supply to which the MEMS microphone is coupled, wherein generating the bias voltage comprises:

generating a reference voltage; and amplifying the reference voltage by an amplifier to generate an amplified reference voltage;

applying the bias voltage to the MEMS microphone, comprising supplying the amplified reference voltage to at least one of the electrode and the movable structure;

processing, by a signal processing circuit, a signal from at least one of the electrode and the movable structure;

using an output signal from the amplifier to control regulation of a voltage; and supplying the regulated voltage to the signal processing circuit.

23. A method according to claim 22, wherein generating the bias voltage comprises generating a bandgap-based reference voltage.

24. A method according to claim 22, wherein generating the bias voltage comprises generating a bandgap-based reference voltage between a bandgap voltage and about 1 volt.

* * * * *